US005507961A

United States Patent [19]

Forster et al.

[11] Patent Number: 5,507,961

[45] Date of Patent: Apr. 16, 1996

[54] HIGH TEMPERATURE CESIUM-CONTAINING SOLID LUBRICANT

[75] Inventors: Nelson H. Forster, Dayton, Ohio; James P. King, Lansdale, Pa.; Lewis Rosado, West Carrollton; Christopher J. Klenke, South Vienna, both of Ohio

[73] Assignee: The United States of America as represented by the Secretary of the Air Force, Washington, D.C.

[21] Appl. No.: 278,535

[22] Filed: Jul. 18, 1994

[51] Int. Cl.[6] ..... C10M 103/06

[52] U.S. Cl. ..... 252/25; 252/12; 252/28

[58] Field of Search ..... 252/25, 28, 12; 106/600, 286.7, 286.8

[56] References Cited

U.S. PATENT DOCUMENTS

| | | | |
|---|---|---|---|
| 3,285,850 | 11/1966 | Graham | 252/28 |
| 3,553,394 | 1/1971 | Zidlicky | 200/11 |
| 4,465,604 | 8/1984 | King | 252/37.2 |
| 4,545,973 | 10/1985 | King | 423/512 R |
| 4,965,001 | 10/1990 | King | 252/30 |
| 5,327,998 | 7/1994 | Rosada et al. | 184/55.1 |

*Primary Examiner*—Prince Willis, Jr.
*Assistant Examiner*—Cephia D. Toomer
*Attorney, Agent, or Firm*—Charles E. Bricker; Thomas L. Kundert

[57] ABSTRACT

A method for lubricating a ceramic bearing surface which comprises applying a cesium-containing compound selected from the group consisting of $Cs_2MoO_4$, $Cs_2SO_4$, $Cs_2WO_4$, $Cs_2WOS_3$, $Cs_2MoOS_3$ and CsOH, to the bearing surface and heating the thus-coated bearing surface to a temperature of about 300° C. or greater. Alternatively, the cesium-containing compound may be applied in admixture with a lower alkali metal silicate. This method is particularly useful for lubricating the bearings in expendable, high temperature turbine engines, such as those used in expendable missiles.

4 Claims, No Drawings

HIGH TEMPERATURE CESIUM-CONTAINING SOLID LUBRICANT

RIGHTS OF THE GOVERNMENT

The invention described herein may be manufactured and used by or for the Government of the United States for all governmental purposes without the payment of any royalty.

BACKGROUND OF THE INVENTION

This invention relates to lubricants for ceramic bearing surfaces, particularly for high temperature applications.

Commonly used solid lubricants or solid lubricant additives are graphite, molybdenum disulfide, polytetrafluoroethylene, lead oxide, boron nitride, alkaline metal borates, arsenic thioantimonate, and the like. These solid lubricants have certain disadvantages, such as limited high temperature stability, hydrolytic instability, potential toxicity, inferior performance under high vacuum or high temperature, or undesirable by-products after exposure to high temperature.

Complex metal chalcogenides such as $K_2MoOS_3$, $K_2WOS_3$, $Cs_2WOS_3$, and $Cs_2MoOS_3$ have been described in the literature. King, U.S. Pat. No. 4,545,973, issued Oct. 8, 1985, found that such compounds possess desirable lubricating properties; however, due to their water solubility, such compounds have limited utility in lubricant applications because they can be leached out of the lubricants when, for example, condensed moisture comes in contact with the lubricants. King discloses complex metal chalcogenides having the formula:

$$Mp(M'\ O_xA_{4-}\ x)m \cdot nH_2O$$

where M is a metal selected from the group consisting of Mg, V. Mn, Fe, Co, Al, Cu, Ga, In, Bi, As, Ni, Zn, Cd, Sb, Sn and Ce; where M' is a metal selected from the group consisting of Mo and W; where A is S or Se; where x ranges from 1 to 3; where p is 1 or 2 depending on the oxidation state of M; where m ranges from 1 to 5 depending on the oxidation state of M; and where n ranges from 0 to 6.

We have found that the lubricating properties of certain cesium compounds are enhanced by silicon.

Accordingly, it is an object of the present invention to provide high temperature cesium-containing solid lubricants.

Another object of this invention is to provide a method for lubricating a ceramic bearing surface.

Other objects, aspects and advantages of the present invention will be apparent to those skilled in the art from a reading of the following detailed disclosure of the invention.

SUMMARY OF THE INVENTION

In accordance with the present invention there is provided a method for lubricating a ceramic bearing surface which comprises applying a cesium-containing compound selected from the group consisting of $CS_2MoO_4$, $CS_2SO_4$, $Cs_2WO_4$, $Cs_2WOS_3$, $Cs_2MoOS_3$ and CsOH, to the bearing surface and heating the thus-coated bearing surface to a temperature of about 300° C. or greater.

In one embodiment, a silicon-containing ceramic bearing surface is lubricated by applying the cesium-containing compound directly to the bearing surface and heating the thus-coated bearing surface to a temperature of about 300° C. or greater.

In another embodiment, a ceramic bearing surface is lubricated by applying a mixture of an alkali metal silicate binder and a cesium-containing compound selected from the group consisting of $Cs_2MoO_4$, $Cs_2SO_4$, $Cs_2WO_4$, $Cs_2WOS_3$, $Cs_2MoOS_3$ and CsOH, to the bearing surface and heating the thus-coated bearing surface to a temperature of about 300° C. or greater. The alkali metal silicate binder can be sodium silicate, lithium silicate or potassium silicate.

In yet another embodiment, a ceramic bearing surface is lubricated by applying cesium silicate to the bearing surface and heating the thus-coated bearing surface to a temperature of about 300° C. or greater.

DESCRIPTION OF THE INVENTION

The more common high temperature ceramics for mechanical application are $Si_3N_4$, $SiO_2$ and SiC. A bearing assembly may comprise, for example, ceramic rod, races and balls with a Clevite® cage, or ceramic balls and a steel cage.

The silicon-containing high temperature ceramics form thin layers of $SiO_2$ when exposed to oxygen at an elevated temperature, i.e., at a temperature of about 300° C. or greater. Such surfaces can be lubricated by applying a cesium-containing compound selected from the group consisting of $CS_2MoO_4$, $Cs_2SO_4$, $Cs_2WO_4$, $Cs_2WOS_3$, $CS_2MoOS_3$ and CsOH, to the bearing surface and heating the thus-coated bearing surface to a temperature of about 300° C. or greater.

Alternatively, the bearing surface is lubricated by applying a mixture of an alkali metal silicate binder and a cesium-containing compound selected from the group consisting of $Cs_2MoO_4$, $Cs_2SO_4$, $Cs_2WO_4$, $Cs_2WOS_3$, $Cs_2MoOS_3$ and CsOH, to the bearing surface and heating the thus-coated bearing surface to a temperature of about 300° C. or greater. The alkali metal silicate binder can be sodium silicate, lithium silicate or potassium silicate. The mixture of metal silicate binder and cesium-containing compound can range from about 4:1 (w/w) to about 1:4 (w/w).

The bearing surface may further be lubricated by applying cesium silicate, alone or mixed with a lower alkali metal silicate, thereto and heating the thus-coated bearing surface to a temperature of about 300° C. or greater.

In each of the embodiments disclosed above, the effectiveness of the lubricant can be enhanced for initial lower temperature operation by adding tungsten disulfide thereto.

The following example illustrates the invention:

EXAMPLE

Lubricant compositions were prepared by mixing about 30–40% by weight of the compounds listed in Table I, below, with sodium silicate. The resulting compositions were diluted with water to give about 20% solution. The cesium silicate was synthesized by combining CsOH and $SiO_2$ (2:1, w/w) and heating this mixture in air to about 70° C. until a liquid solution was obtained.

TABLE I

| Component(s) | Composition No. |
|---|---|
| $Cs_2WOS_3 + WS_2$ (1:1, w/w) | I |
| $Cs_2SiO_3 + WS_2$ (1:1, w/w) | II |
| $Cs_2SO_4 + WS_2$ (1:1, w/w) | III |
| $Cs_2WO_4 + WS_2$ (1:1, w/w) | IV |
| $Cs_2SiO_3$ | V |

TABLE I-continued

| Component(s) | Composition No. |
|---|---|
| $ZnMoOS_3$ | VI |

The dilute aqueous compositions were sprayed on the bearing surface(s) of a bearing assembly comprising silicon nitride rod, races and bails, with a Clevite® cage. After drying, the bearing surface(s) had an average thickness of lubricant of about 1 mil. Table II, below, lists the bearing life, average friction force and rod wear volume per stress cycle at 649° C., 4.34 Gpa., using a standard test apparatus. For comparison, results are shown for sodium silicate, alone, and for tungsten disulfide, alone. For the latter, the bearing assembly comprised T-15 rod and races, 4340 steel cage and silicon nitride balls; the tests were carried out at 316° C., 3.65 Gpa.

TABLE II

| | Life (hours) | | | Avg. Friction Force (N) | | | Rod Wear Vol. per Stress Cycle ($mm^3 \times E-9$) | | |
|---|---|---|---|---|---|---|---|---|---|
| I | 57.4 | 39.3 | 31.4 | 0.266 | 0.220 | 0.182 | 5.6 | 24.0 | 3.7 |
| II | 21.4 | 15.1 | 36.5 | 0.082 | 0.129 | 0.077 | 9.2 | 8.3 | 108.2 |
| III | 76.0 | 33.5 | 47.4 | 0.125 | 0.346 | 0.192 | 120.2 | 11.1 | 35.1 |
| IV | 38.7 | 19.0 | 50.2 | 0.125 | 0.110 | 0.101 | 14.8 | 164.6 | 35.1 |
| V | | 91.0 | | | 0.278 | | | 3.7 | |
| VI | | 0.9 | | | 0.269 | | | 46.2 | |
| $Na_2SiO_3$ | | nil | | | 0.444 | | | nil | |
| $WS_2$ | | nil | | | 0.624 | | | 573.0 | |

Examination of the above data reveals that neither $WS_2$ (at 316° C.) nor sodium silicate (at 649° C.) provide high temperature lubrication. Similarly, $ZnMoOS_3$ in sodium silicate (VI) provides almost no high temperature lubrication. In contrast, the cesium-containing compounds, either alone or in combination with tungsten disulfide, provide excellent lubrication at the relatively high operating temperature of 649° C.

The method of the present invention is particularly useful for lubricating the bearings in expendable, high temperature turbine engines, such as those used in expendable missiles.

Various modifications may be madein the instant invention without departing from the spirit and scope of the appended claims.

We claim:

1. A method for lubricating a silicon-containing ceramic bearing surface which comprises applying a cesium-containing compound selected from the group consisting of $Cs_2MoO_4$, $Cs_2SO_4$, $Cs_2WO_4$ and CsOH, to the bearing surface and heating the thus-coated bearing surface to a temperature of about 300° C. or greater.

2. The method of claim 1 wherein tungsten disulfide is applied to said bearing surface in admixture with said cesium compound.

3. A method for lubricating a ceramic bearing surface which comprises applying a mixture of an alkali metal silicate binder and a cesium-containing compound selected from the group consisting of $Cs_2MoO_4$, $Cs_2SO_4$, $Cs_2WO_4$, $Cs_2WOS_3$, $Cs_2MoOS_3$ and CsOH, to the bearing surface and heating the thus-coated bearing surface to a temperature of about 300° C. or greater, wherein said alkali metal silicate binder is selected from the group consisting of sodium silicate, lithium silicate and potassium silicate.

4. The method of claim 3 wherein tungsten disulfide is applied to said bearing surface in admixture with said cesium compound.

* * * * *

UNITED STATES PATENT AND TRADEMARK OFFICE

CERTIFICATE OF CORRECTION

PATENT NO. : 5,507,961

DATED : April 16, 1996

INVENTOR(S) : Nelson H. Forster et al.

It is certified that error appears in the above-indentified patent and that said Letters Patent is hereby corrected as shown below:

Col. 1, line 24 "$Cs_2MoOSe_2$" should read -- $Cs_2MoOSe_3$ --.

Col. 3, line 10, "bails" should read --balls--.

Signed and Sealed this

Eighth Day of October, 1996

*Attest:*

*Attesting Officer*

BRUCE LEHMAN

*Commissioner of Patents and Trademarks*

--